US007305938B2

(12) United States Patent
Watanabe

(10) Patent No.: US 7,305,938 B2
(45) Date of Patent: Dec. 11, 2007

(54) STROKE-VARIABLE ENGINE

(75) Inventor: Sei Watanabe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/507,662

(22) Filed: Aug. 22, 2006

(65) Prior Publication Data

US 2007/0125326 A1 Jun. 7, 2007

(30) Foreign Application Priority Data

Aug. 29, 2005 (JP) ..... 2005-247794
Aug. 29, 2005 (JP) ..... 2005-247795

(51) Int. Cl.
*F02B 75/04* (2006.01)

(52) U.S. Cl. ..... 123/21; 123/48 B; 123/197.4

(58) Field of Classification Search ..... 123/21, 123/48 B, 197.1, 197.4, 197.3
See application file for complete search history.

(56) References Cited

U.S. PATENT DOCUMENTS 5,947,074 A * 9/1999 Yapici ..... 123/192.2
6,499,452 B2 * 12/2002 Ma ..... 123/90.17
7,210,446 B2 * 5/2007 Sic et al. ..... 123/197.4
2007/0044740 A1 * 3/2007 Watanabe et al. ..... 123/78 F
2007/0169739 A1 * 7/2007 Meyer et al. ..... 123/197.4

FOREIGN PATENT DOCUMENTS

| | | |
|---|---|---|
| JP | 10-176508 | 6/1998 |
| JP | 2003-314211 | 11/2003 |
| JP | 2003-314237 A | 11/2003 |
| KR | 1998-064207 | 10/1998 |
| KR | 2003-0082450 | 10/2003 |

* cited by examiner

*Primary Examiner*—Stephen K. Cronin
*Assistant Examiner*—Jason Benton
(74) *Attorney, Agent, or Firm*—Arent Fox LLP

(57) ABSTRACT

A stroke-variable engine includes a pivot shaft which is rotatably supported in a crankcase so as to be rotatable about an eccentric axis parallel to a crankshaft and which is connected to a control rod so that a rotational power reduced at a reduction ratio of 1/2 is transmitted from the crankshaft to the pivot shaft. A camshaft of a valve-operating mechanism mounted at an upper portion of an engine body and the pivot shaft are operatively connected to each other. Thus, it is possible to decrease the number of parts of the valve-operating mechanism, increase a rotational speed, and further reduce mechanical noise.

7 Claims, 5 Drawing Sheets

STROKE-VARIABLE ENGINE

RELATED APPLICATION DATA

The present invention is based upon Japanese priority application Nos. 2005-247794 and 2005-247795, which are hereby incorporated in their entirety herein by reference.

BACKGROUND OF THE INVENTION

1. Field of the Invention

The present invention relates to a stroke-variable engine, and particularly to a stroke-variable engine comprising: a main connecting rod connected at one end to a piston through a piston pin; a subsidiary connecting rod which is connected to a crankpin of a crankshaft rotatably supported in a crankcase of an engine body and which is connected to the other end of the main connecting rod; a control rod connected at one end to the subsidiary connecting rod at a position offset from a connected position of the main connecting rod; and a pivot shaft which is rotatably supported in the crankcase so as to be rotatable about an eccentric axis parallel to the crankshaft and which is connected to the other end of the control rod so that a rotational power reduced at a reduction ratio of 1/2 is transmitted from the crankshaft to the pivot shaft.

2. Description of the Related Art

Japanese Patent Application Laid-open No. 2003-314237 discloses a conventional stroke-variable engine wherein a control rod connected at one end to a subsidiary connecting rod is connected at the other end to a pivot shaft provided on a rotary shaft having an axis parallel to a crankshaft so that the stroke of a piston is varied.

In the stroke-variable engine disclosed in the Japanese Patent Application Laid-open No. 2003-314237, a valve-operating mechanism is constructed to be an OHV-type in which a rotary shaft is also used as a camshaft. If such an OHV-type valve-operating mechanism is used, not only increased is the number of parts constituting the valve-operating mechanism such as a push rod, but also the valve-operating mechanism has a relatively large weight. Therefore, it is difficult to increase the rotational speed, and a relatively large mechanical noise is generated due to a large number of contact portions between parts constituting the valve-operating mechanism.

SUMMARY OF THE INVENTION

Accordingly, it is an object of the present invention to provide a stroke-variable engine wherein a valve-operating mechanism has a reduced number of parts, a rotational speed is increased, and mechanical noise is reduced.

In order to achieve the above object, according to a first feature of the present invention, there is provided a stroke-variable engine comprising: a main connecting rod connected at one end to a piston through a piston pin; a subsidiary connecting rod which is connected to a crankpin of a crankshaft rotatably supported in a crankcase of an engine body and which is connected to the other end of the main connecting rod; a control rod connected at one end to the subsidiary connecting rod at a position offset from a connected position of the main connecting rod; and a pivot shaft which is rotatably supported in the crankcase so as to be rotatable about an eccentric axis parallel to the crankshaft and which is connected to the other end of the control rod so that a rotational power reduced at a reduction ratio of 1/2 is transmitted from the crankshaft to the pivot shaft, wherein a camshaft of a valve-operating mechanism mounted at an upper portion of the engine body and the pivot shaft are operatively connected to each other.

With the first feature, the valve-operating mechanism is constructed to be the OHC-type, and hence it is possible to reduce the number of parts constituting the valve-operating mechanism, and to easily increase the rotational speed by constructing the vale-operating mechanism to have a relatively small weight. Moreover, it is possible to reduce the mechanical noise by decreasing the number of the contact portions between the parts constituting the valve-operating mechanism.

According to a second feature of the present invention, in addition to the first feature, the pivot shaft is provided at an eccentric position on a rotary shaft which is rotatably supported in the crankcase so as to be rotatable about the eccentric axis as a rotational axis and to which the rotational power reduced at a reduction ratio of 1/2 is transmitted from the crankshaft; and a timing transmitting means is mounted between the camshaft and the rotary shaft, and comprises a driven wheel mounted on the camshaft, a drive wheel mounted on the rotary shaft, and an endless power transmitting belt wound around the drive wheel and the driven wheel.

With the second feature, the timing transmitting means for transmitting the rotational power reduced at a reduction ratio of 1/2 from the crankshaft to the camshaft of the valve-operating mechanism is mounted between the camshaft and the rotary shaft to which the rotational power reduced to 1/2 is transmitted from the crankshaft. Therefore, it is possible to downsize the driven wheel mounted on the camshaft to downsize the upper portion of the engine body. Moreover, only a component of an explosive force received by the crankshaft through the main connecting rod and the subsidiary connecting rod is applied to the rotary shaft having the pivot shaft provided thereon. Therefore, it is possible to set the diameter of the rotary shaft to be smaller than that of the crankshaft, reduce the diameter of the driving wheel, as compared with a case where the driving wheel is mounted on the crankshaft, and correspondingly reduce the diameter of the driven wheel. It is also possible to compactly construct the timing transmitting means, thereby downsizing the engine body not only in its upper portion but also its entirety, leading to an improvement in mountability to a working machine or the like. Moreover, if the diameter of the driving wheel is too small, the wound radius of the endless power transmitting belt is decreased, resulting in an increase in bending load to cause a problem in durability. However, by mounting of the driving wheel on the rotary shaft where the rotational speed has been already reduced to 1/2, the diameter of the driving wheel can be set in an appropriate range, leading to an improvement in durability of the endless power transmitting belt.

According to a third feature of the present invention, in addition to the second feature, a rotary shaft drive means for transmitting the rotational power from the crankshaft to the rotary shaft at a reduction ratio of 1/2 and the timing transmitting means are separately disposed on axially opposite sides of the crankpin.

With the third feature, the rotary shaft drive means for reducing the rotational power from the crankshaft to 1/2 and the timing transmitting means are separately disposed on the axially opposite sides of the crankpin, respectively, so that a component of an explosive force received by the crankshaft is applied to a substantially central portion of the rotary shaft. Therefore, distances between bearings at opposite ends of the crankshaft and the rotary shaft can be set to be substantially equal, leading to an enhancement in durability of the rotary shaft, and the shaft loads applied to the opposite ends of the rotary shaft 46 can be substantially equalized, and thus the sizes of support portions at the opposite ends of the rotary shaft 46 can be reduced.

According to a fourth feature of the present invention, in addition to the second feature, the crankcase comprises a case body with its one side opened, and a side cover coupled to an end of the opened side of the case body; and a rotary shaft drive means for transmitting the rotational power from the crankshaft to the rotary shaft at a reduction ratio of 1/2 and the timing transmitting means are disposed between the crankpin and the side cover, the timing transmitting means being disposed on the side of the side cover.

With the fourth feature, the timing transmitting means and the rotary shaft drive means are disposed sequentially from the side of the side cover between the crankpin of the crankshaft and the side cover. Therefore, the driving wheel of the timing transmitting means required to be matched in timing can be mounted on the side of the side cover, thereby facilitating the visual check of a timing mark and also facilitating the assembling of the rotary shaft drive means, leading to an improvement in assimilability.

According to a fifth feature of the present invention, in addition to any of the second to fourth features, the crankshaft includes a pair of balance weights which sandwich the subsidiary connecting rod from opposite sides. With the fifth feature, the crankshaft includes the pair of balance weights disposed on the opposite side of the subsidiary connecting rod, and hence it is possible to improve the balance of a force applied to the crankshaft.

According to a sixth feature of the present invention, in addition to the first feature, the timing transmitting means for transmitting the rotational power of the crankshaft at a reduction ratio of 1/2 is mounted between the camshaft of the valve-operating mechanism mounted at an upper portion of the engine body and the crankshaft; and the pivot shaft having an axis eccentric from the rotational axis of the camshaft is provided on the camshaft.

With the sixth feature, the rotational power reduced by the timing transmitting means at a reduction ratio of 1/2 is transmitted from the crankshaft to the camshaft of the valve-operating mechanism mounted at the upper portion of the engine body. In this arrangement, because the pivot shaft is provided on the camshaft, it is unnecessary to secure a space for disposition of the rotary shaft, as compared with a case where the rotary shaft having the pivot shaft is rotatably supported in the crankcase. Thus, it is possible to compactly construct the crankcase and to set the height of the engine to be lower. Moreover, it is unnecessary to provide a reducing drive mechanism for driving the rotary shaft between the rotary shaft and the crankshaft, and hence it is possible to reduce the length of the crankshaft to compactly construct the entire engine. It is also possible to reduce the number of parts by eliminating the need of the rotary shaft. Further, the control rod is formed between the lower and upper portions of the engine body so as to have a relatively large length, but it is possible to suppress the wearing by a reduced deflection amount of the control rod at a point of connection to the subsidiary connecting rod. Moreover, the control rod having a weight increased due to the relatively large length performs a counter weight function, and thus it is possible to improve the dynamic balance of the crankshaft.

According to a seventh feature of the present invention, in addition to the sixth feature, centerlines of the main connecting rod and the control rod are disposed on the same plane. With the seventh feature, the main connecting rod, the subsidiary connecting rod and the control rod can be disposed compactly in the direction perpendicular to the axis of the crankshaft, and the distance between the bearings at opposite ends of the crankshaft can be reduced. Further, a load on the main connecting rod and the subsidiary connecting rod due to an explosive force can be decreased by the displacement of the control rod toward the crankshaft.

The above and other objects, features and advantages of the invention will become apparent from the preferred embodiments taken in conjunction with the accompanying drawings.

BRIEF DESCRIPTION OF THE DRAWINGS

FIGS. 1 and 2 show a first embodiment of the present invention wherein FIG. 1 is a vertical sectional view of an engine; taken along a line 1-1 in FIG. 2; and FIG. 2 is a sectional view taken along a line 2-2 in FIG. 1.

FIGS. 4 and 5 show a third embodiment of the present invention wherein FIG. 4 is a vertical sectional view of an engine, taken along a line 4-4 in FIG. 5; and FIG. 5 is a sectional view taken along a line 5-5 in FIG. 4.

DETAILED DESCRIPTION OF PREFERRED EMBODIMENTS

Figure 1:
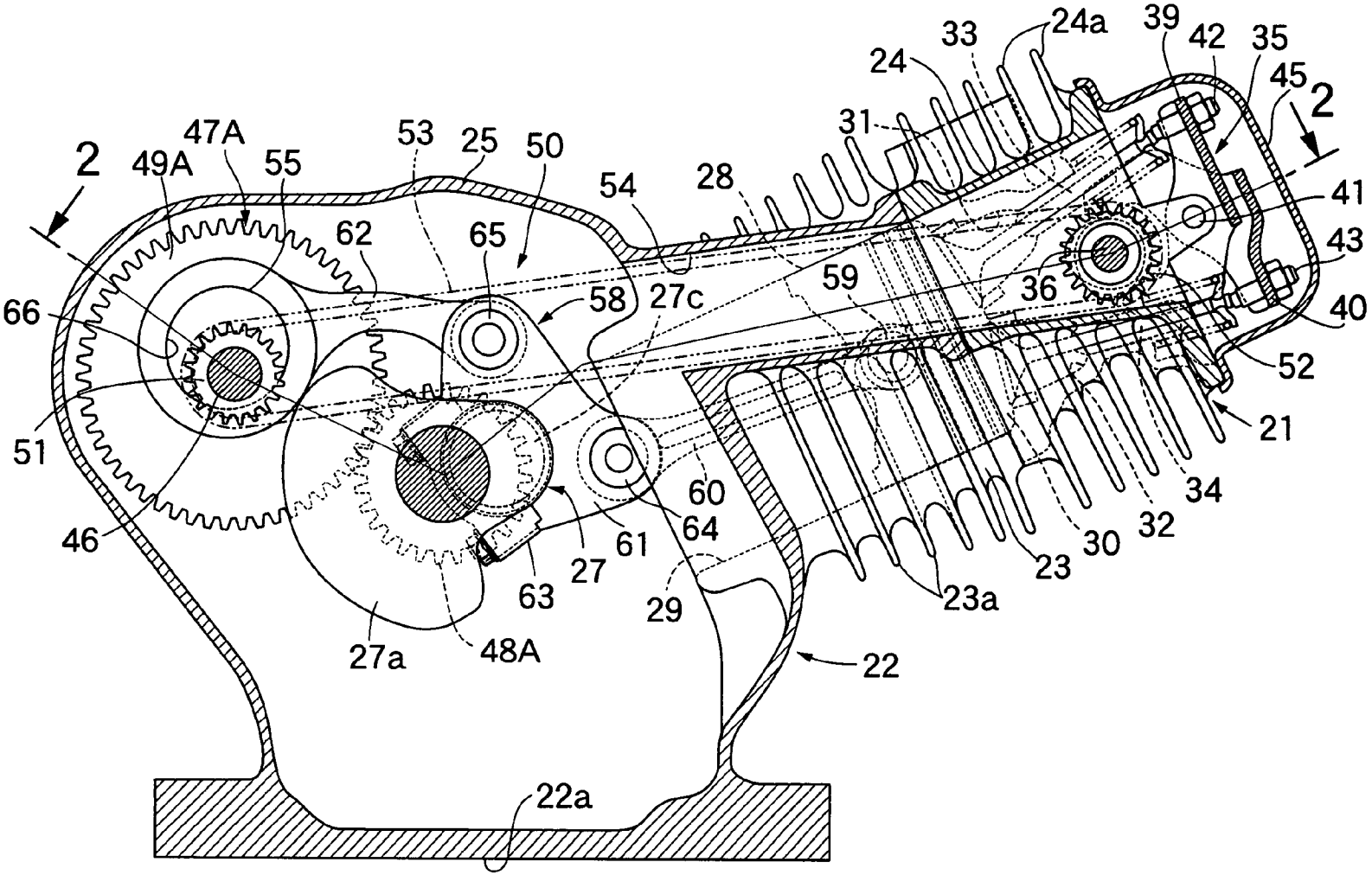
Figure 2:
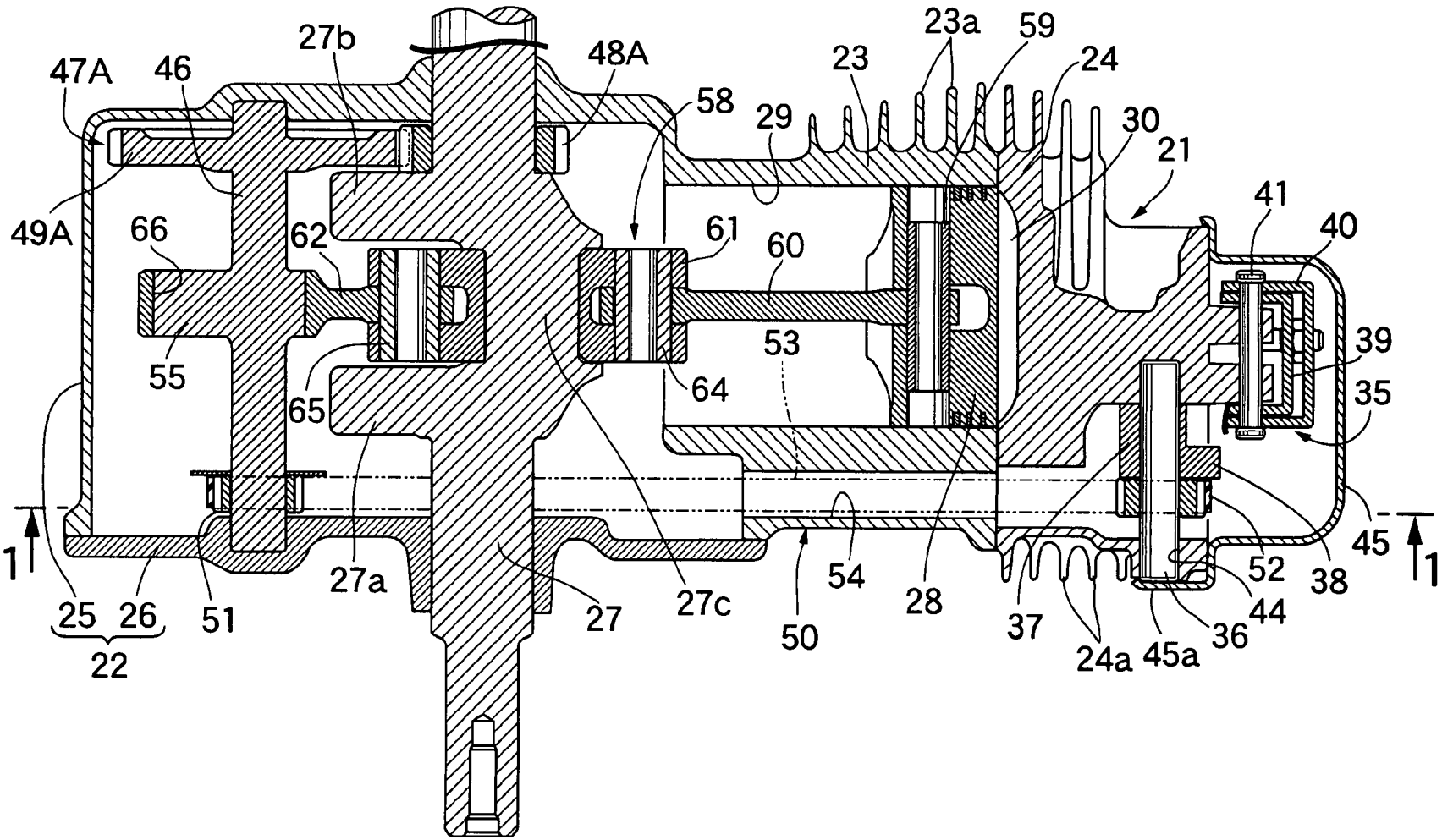

A first embodiment of the present invention will now be described with reference to FIGS. 1 and 2. An engine according to the first embodiment is an air-cooled single-cylinder engine used, for example, in a working machine or the like, and has an engine body 21 which comprises: a crankcase 22; a cylinder block 23 slightly inclined upwards and protruding from one side of the crankcase 22; and a cylinder head 24 coupled to a head of the cylinder block 23. A large number of air-cooling fins 23*a* and 24*a* are provided on outer surfaces of the cylinder block 23 and the cylinder head 24. The crankcase 22 is installed on a cylinder head of any working machine via an installation surface 22*a* of its lower face.

The crankcase 22 comprises a case body 25 formed integrally with the cylinder block by casting to have one side opened, and a side 26 cover coupled to an end of the opened side of the case body 25. A crankshaft 27 integrally comprises a pair of balance weights 27*a* and 27*b*, and a crankpin 27*c* interconnecting both of the balance weights 27*a* and 27*b*, and is rotatably supported on the case body 25 and the side cover 26.

A cylinder bore 29 slidably receiving therein a piston 28 is formed in the cylinder block 23. A combustion chamber 30 is formed between the cylinder block 23 and the cylinder head 24 so that a top of the piston 28 faces the combustion chamber 30. An intake port 31 and an exhaust port 32 are formed in the cylinder head 24 so that they can communicate with the combustion chamber 30. An intake valve 33 for connecting and disconnecting the intake port 31 and the combustion chamber 30 to and from each other as well as an exhaust valve 34 for connecting and disconnecting the exhaust port 32 and the combustion chamber 30 to and from each other, are openably and closably disposed in the cylinder head 24.

A valve-operating mechanism 35 for opening and closing the intake valve 33 and the exhaust valve 34 is mounted at an upper portion of the engine body 21. The valve-operating mechanism 35 comprises: a camshaft 36 rotatably driven at a reduction ratio of 1/2 from the crankshaft 27; an intake-side cam 37 and an exhaust-side cam 38 fixed to the camshaft 36 so as to be ratable along with the camshaft 36; and intake-side and exhaust-side rocker arms 39 and 40 swung following the cams 37 and 38. Each of the intake-side and exhaust-side rocker arms 39 and 40 is swingably supported at one end on the cylinder head 24 through a common swinging support shaft 41 having an axis parallel to the crankshaft 27. Tappet screws 42 and 43 are threadedly engaged with the other ends of the intake-side and exhaust-side rocker arms 39 and 40 to abut against upper ends of the intake valve 33 and the exhaust valve 34, so that their advanced and retracted positions can be regulated.

The camshaft 36 is rotatably supported in the cylinder head 24, and has an axis parallel to the crankshaft 27. A fitting bore 44 for fitting of the cam shaft 36 is provided to open into one side of the cylinder head 24. Thus, the valve-operating mechanism 35 is covered with a head cover 45, which is coupled to the cylinder head 24 and has a lid portion 45*a* for closing an outer end of the fitting bore 44 so as to inhibit the detachment of the camshaft 36 from the fitting bore 44.

A rotary shaft 46 having an axis parallel to the crankshaft 27 and a rotational axis above the axis of the crankshaft 27 is rotatably supported at its opposite ends in the case body 25 and the side cover 26 of the crankcase 22. A rotary shaft drive means 47A is mounted between the rotary shaft 46 and the crankshaft 27, and transmits the rotational power of the crankshaft 27 to the rotary shaft 46 with rotational power reduction. On the other hand, a timing transmitting means 50 is mounted between the camshaft 36 of the valve-operating mechanism 35 and the rotary shaft 46, and transmits the rotational power of the rotary shaft 46 without rotational power reduction. Moreover, the rotary shaft drive means 47A and the timing transmitting means 50 are disposed so that they are separately disposed on axially opposite sides of the crankpin 27*c*, and the crankpin 27*c* is provided between the pair of balance weights 27*a* and 27*b*. Therefore, the rotary shaft drive means 47A and the timing transmitting means 50 are disposed on opposite sides of the pair of balance weights 27*a* and 27*b* provided on the crankshaft 27.

The rotary shaft drive means 47A comprises a driving gear 48A fixed to the crankshaft 27, and a driven gear 49A integrally provided on the rotary shaft 46 so as to be meshed with the driving gear 48A. The driving gear 48A is fixed to the crankshaft 27 between one 27*b* of the pair of balance weights 27*a* and 27*b* of the crankshaft 27 opposite from the side cover 26 and the closed end of the body 25. The driven gear 49A is integrally formed on the rotary shaft 46 in correspondence to the driving gear 48A.

The timing transmitting means 50 is disposed between one 27*a* of the pair of balance weights 27*a* and 27*b* of the crankshaft 27 on the side of the side cover 26, and the side cover 26. The timing transmitting means 50 comprises: a drive sprocket 51 as a drive wheel fixed to the rotary shaft 46; a driven sprocket 52 as a driven wheel mounted on the camshaft 36; and a timing toothed belt 53 as an endless transmitting band wound around the drive sprocket 51 and the driven sprocket 52. A timing belt chamber 54, in which the timing belt 53 is allowed to travel, is formed in the cylinder block 23 and the cylinder head 24.

A pivot shaft 55 having an axis at a position eccentric from the axis of the rotary shaft 46 is integrally provided on the rotary shaft 46 at a position between the pair of balance weights 27*a* and 27*b* of the crankshaft 27. The pivot shaft 55, the piston 28 and the crankshaft 27 are connected to one another through a link mechanism 58.

The link mechanism 58 comprises: a main connecting rod 60 connected at one end to the piston 28 through a piston pin 59; a subsidiary connecting rod 61 disposed between both the balance weights 27*a* and 27*b* of the crankshaft 27, connected to the crankpin 27*c*, and connected to the other end of the main connecting rod 60; and a control rod 62 connected at one end to the subsidiary connecting rod 61 at a position offset from the connected position of the main connecting rod 60, and connected at other end to the pivot shaft 55.

The subsidiary connecting rod 61 is formed to come into sliding contact with one half of a peripheral surface of the crankpin 27*c*. A crank cap 63 mounted to come into sliding contact with the remaining half of the peripheral surface of the crankpin 27*c* is fastened to the subsidiary connecting rod 61.

The main connecting rod 60 is turnably connected at other end to one end of the subsidiary connecting rod 61 through a first pin 64. The control rod 62 is turnably connected at one end to the subsidiary connecting rod 61 through a second pin 65, and a circular shaft bore 66 is provided in the other end of the control rod 62, so that the pivot shaft 55 is relatively slidably fitted in the circular shaft bore 66.

Thus, the rotary shaft 46 is rotatably driven at a reduction ratio of 1/2 in response to the rotation of the crankshaft 27, and as the pivot shaft 55 is rotated about the rotational axis of the rotary shaft 46, the link mechanism 58 is operated so that the stroke of the piston 28 at the expansion stroke is larger than that at the compression stroke, thereby performing a larger expansion task with the same amount of air-fuel mixture drawn. In this manner, a cycle heat efficiency can be enhanced.

The operation of the first embodiment will be described below. The camshaft 36 of the valve-operating mechanism 35 mounted at the upper portion of the engine body 21 is connected to the pivot shaft 55 through the timing transmitting means 50, and the valve-operating mechanism 35 is constructed to be an OHC-type. Therefore, it is possible to decrease the number of parts constituting the valve-operating mechanism 35, and to construct the valve-operating mechanism 35 with a relatively small weight, thereby easily increasing the rotational speed. Moreover, it is possible to reduce the mechanical noise by decreasing the number of contact portions between the parts constituting the valve-operating mechanism 35.

In addition, the pivot shaft 55 is mounted at the position eccentric from the rotary shaft 46 to which the rotational power reduced to 1/2 is transmitted from the crankshaft 27. The timing transmitting means 50 comprises the a driven sprocket 52 mounted on the camshaft 36, and the driving sprocket 51 mounted on the rotary shaft 46, and the timing toothed belt 53 wound around the driving sprocket 51 and the driven sprocket 52; and is mounted between the camshaft 36 and the rotary shaft 46 so as to transmit the rotational power reduced to 1/2 from the crankshaft 27 to the camshaft 36. Therefore, it is possible to downsize the driven sprocket 52 mounted on the camshaft 36 to downsize the upper portion of the engine body 21. Moreover, only a component of an explosive force received by the crankshaft 27 through the main connecting rod 60 and the subsidiary connecting rod 61 is applied to the rotary shaft 46 having the pivot shaft 55 provided thereon. Therefore, it is possible to set the diameter of the rotary shaft 46 to be smaller than that of the crankshaft 27, and to reduce the diameter of the driving sprocket 51, as compared with a case where the driving sprocket 51 is mounted on the crankshaft 27, and correspondingly reduce the diameter of the driven sprocket 52. Thus, it is possible to compactly construct the timing transmitting means 50, thereby downsizing the engine body 21 not only in its upper portion but also its entirety, leading to an improvement in mountability to a working machine or the like.

Moreover, if the diameter of the driving sprocket 51 is too small, the wound radius of the timing toothed belt 53 is decreased, resulting in an increase in bending load to cause a problem in durability. However, by mounting of the driving sprocket 51 on the rotary shaft 46 where the rotational speed has been already reduced to 1/2, the diameter of the driving sprocket 51 can be set in an appropriate range, leading to an improvement in durability of the timing toothed belt 53.

By disposing the rotational axis of the rotary shaft 46 above the axis of the crankshaft 27, the distance between the driving sprocket 51 and the driven sprocket 52 can be set to be relatively small, leading to a decrease in the length of the timing toothed belt 53.

The rotary shaft drive means 47A for transmitting the rotational power from the crankshaft 27 to the rotary shaft 46 at a reduction ratio of 1/2 and the timing transmitting means 50, are separately disposed on the axially opposite sides of the crankpin 27*c*, respectively, so that the component of the explosive force received by the crankshaft 27 is applied to a substantially central portion of the rotary shaft 46. Therefore, the distances between the bearings at opposite ends of the crankshaft 27 and the rotary shaft 46 can be set to be substantially equal, thereby improving durability of the rotary shaft 46, and shaft loads applied to the opposite ends of the rotary shaft 46 can be substantially equalized, thereby downsizing support portions at the opposite ends of the rotary shaft 46 can be reduced.

In addition, the driving sprocket 51 of the timing transmitting means 50 required to be matched in timing is mounted on the rotary shaft 46 between the side cover 26 and one 27*a* of the pair of balance weights 27*a* and 27*b* of the crankshaft 27 on the side of the side cover 26. Therefore, it is possible to facilitate the visual checking on a timing mark and to enhance the assimilability.

Moreover, because the crankshaft 27 includes the pair of balance weights 27*a* and 27*b* disposed on the opposite sides of the subsidiary connecting rod 61, the balance of the force applied to the crankshaft 27 can be excellent.

Figure 3:
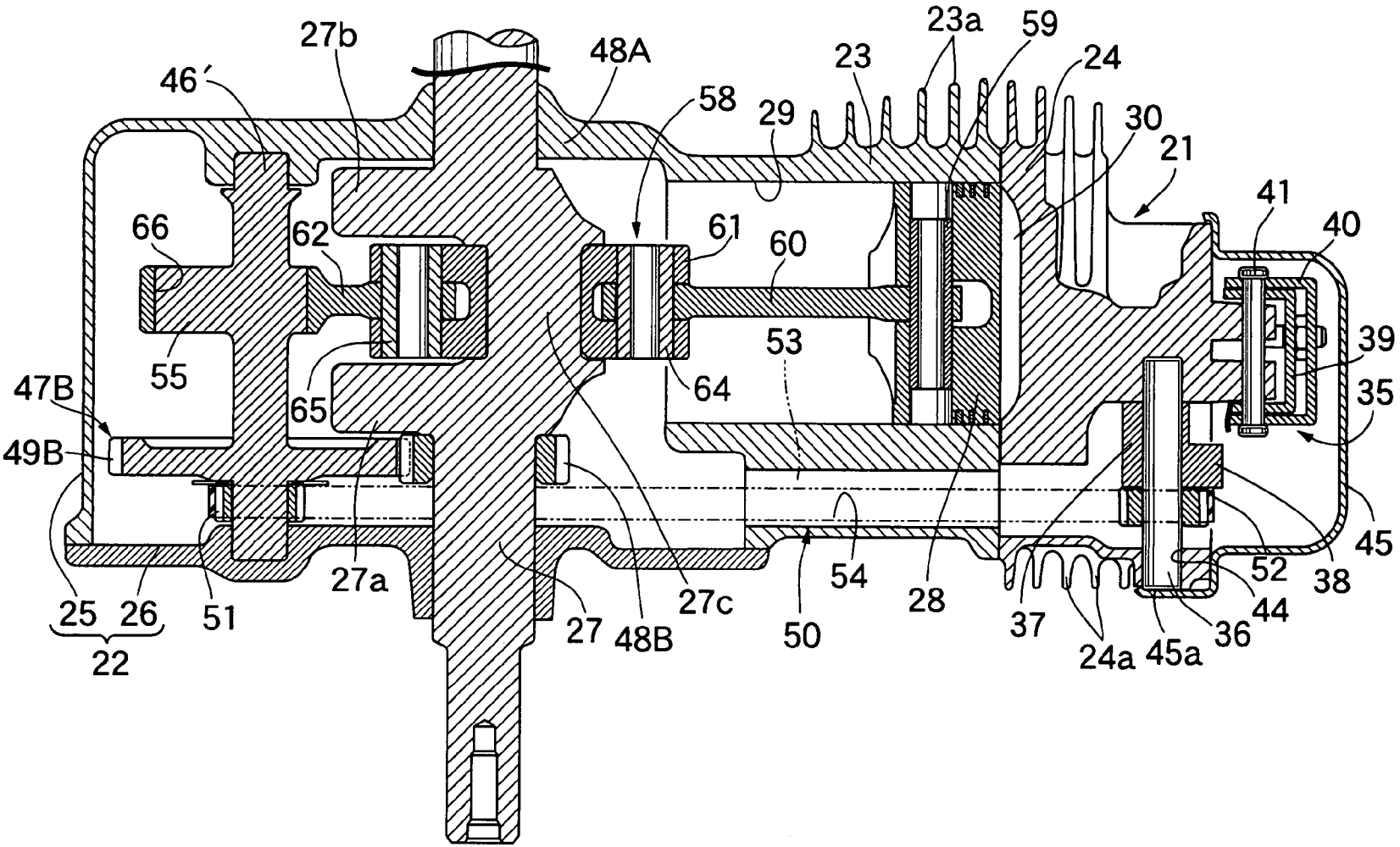
FIG. 3 is a sectional view similar to FIG. 2, but according to a second embodiment.

FIG. 3 shows a second embodiment of the present invention, wherein portions and components corresponding to those in the first embodiment are designated by the same reference numerals, and merely shown, and the detailed description of them is omitted.

A rotary shaft drive means 47B for transmitting the rotational power from a crankshaft 27 to a rotary shaft 46' at a reduction ratio of 1/2 comprises a driving gear 48B fixed to the crankshaft 27, and a driven gear 49B integrally provided in the rotary shaft 46' so that it is meshed with the driving gear 48B. The driving gear 48B is fixed to the crankshaft 27 between a crankpin 27*c* of the crankshaft 27 and a side cover 26, and opposite ends of the crankpin 27*c* interconnect a pair of balance weights 27*a* and 28*b*. Therefore, the driving gear 48B is fixed to the crankshaft 27 between the side cover 27 and one 27*a* of the balance weights 27*a* and 28*b* on the side of the side cover 26.

Moreover, a timing transmitting means 50 is mounted between the camshaft 36 of the valve-operating mechanism 35 and the rotary shaft 46', and disposed between the side cover 27 and one 27*a* of the balance weights 27*a* and 28*b* on the side of the side cover 26. The timing transmitting means 50 comprises a driving sprocket 51 fixed to the rotary shaft 46', a driven sprocket 52 mounted on the camshaft 36, and a timing belt 53 wound around the driving sprocket 51 and the driven sprocket 52.

Namely, the rotary shaft drive means 47B and the timing transmitting means 50 are disposed between the balance weight 27*a* connected to one end of the crankpin 27*c* and the side cover 26, but the timing transmitting means 50 is disposed at a position closer to the side cover 26 than the rotary shaft drive means 47B.

According to the second embodiment, the driving sprocket 51 of the timing transmitting means 50 required to be matched in timing can be mounted on the side of the side cover 26, thereby facilitating the visual checking on a timing mark, and also facilitating the assembling of the rotary shaft drive means 47B to improve the assimilability.

Figure 4:
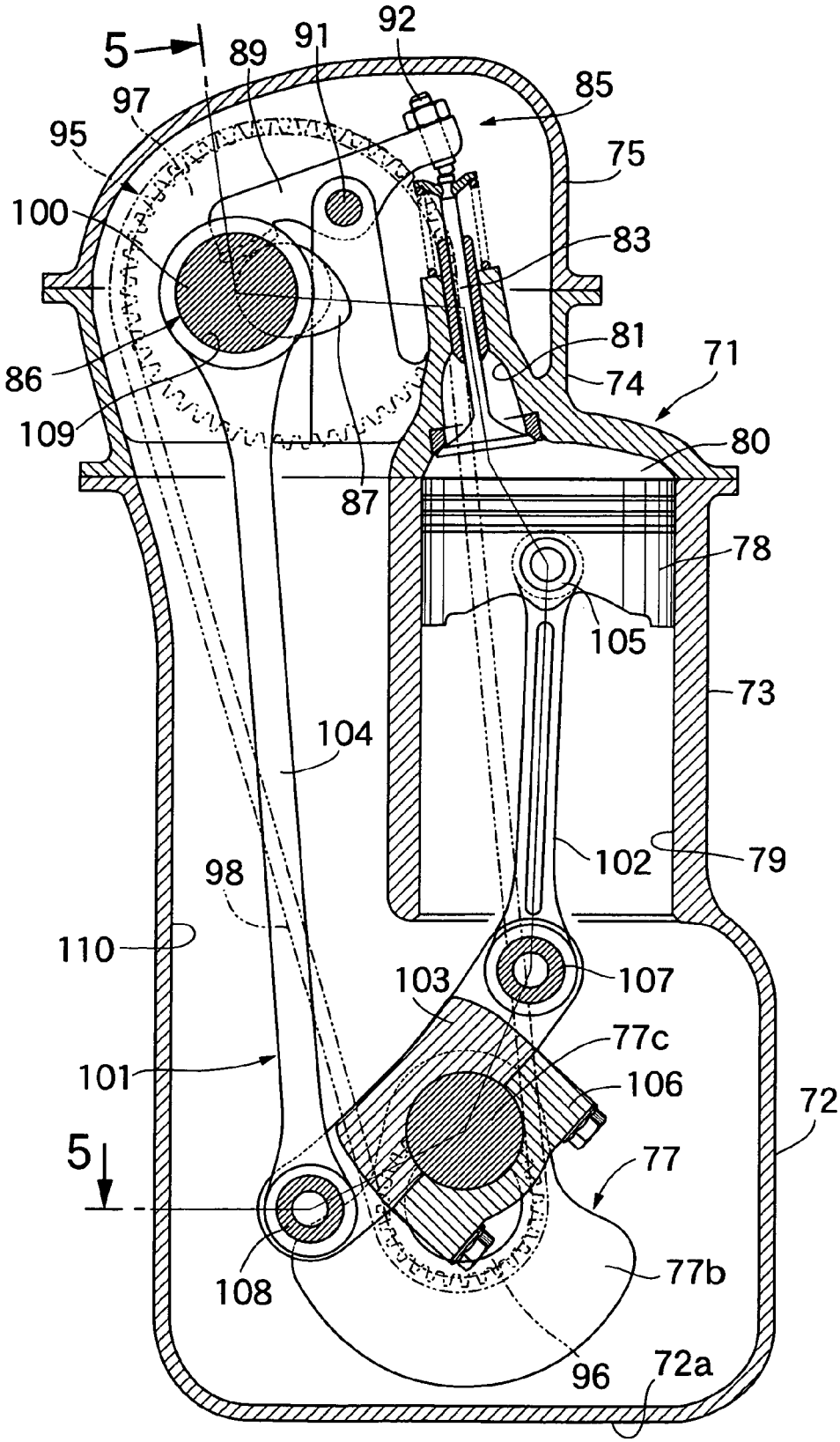
Figure 5:
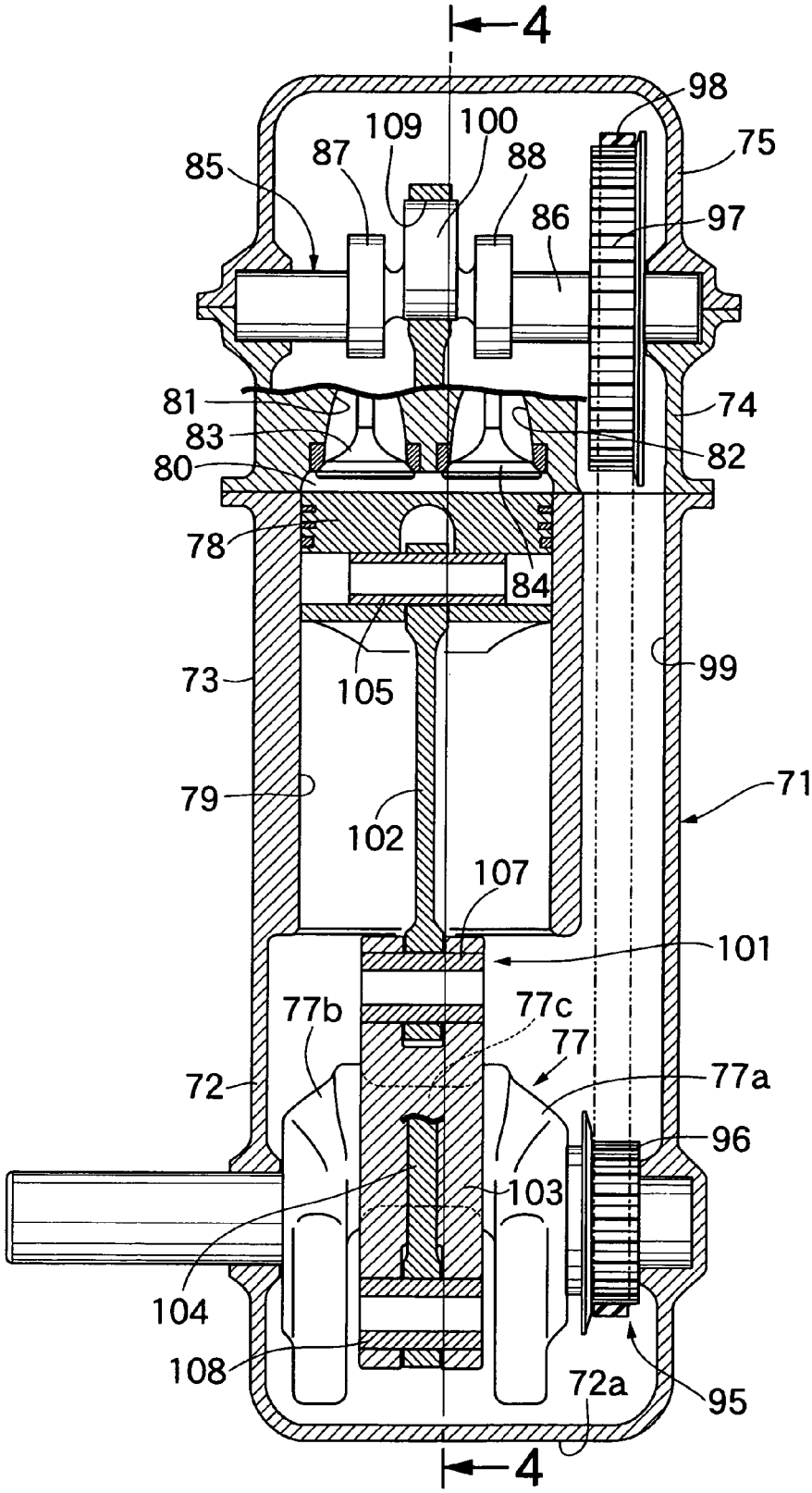

A third embodiment of the present invention will now be described with reference to FIGS. 4 and 5. An engine is an air-cooled single-cylinder engine used, for example, in a working machine or the like, and has an engine body 71 which comprises: a crankcase 72; a cylinder block 73 slightly inclined upwards and protruding from one side of the crankcase 72; a cylinder head 74 coupled to a head of the cylinder block 23; and a head cover 75 coupled to the cylinder head 74. The crankcase 72 is installed on a cylinder head of any working machine via an installation surface 72*a* of its lower face.

A crankshaft 77 is rotatably supported in a crankcase 72, and integrally provided with a pair of balance weights 77*a* and 77*b* and a crankpin 77*c* interconnecting both the balance weights 77*a* and 77*b*.

A cylinder bore 79 slidably receiving therein a piston 78 is formed in the cylinder block 73. A combustion chamber 80 is formed between the cylinder block 73 and the cylinder head 74 so that a top of the piston 78 faces the combustion chamber 80. An intake port 81 and an exhaust port 82 are formed in the cylinder head 24 so that they can communicate with the combustion chamber 80. An intake valve 83 for connecting and disconnecting the intake port 81 and the combustion chamber 80 to and from each other as well as an exhaust valve 84 for connecting and disconnecting the exhaust port 82 and the combustion chamber 80 to and from each other, are openably and closably disposed in the cylinder head 24.

A valve-operating mechanism 85 for opening and closing the intake valve 83 and the exhaust valve 84 includes: a camshaft 86 rotatably driven at a reduction ratio of 1/2 from the crankshaft 27; an intake-side cam 87 and an exhaust-side cam 88 provided on the camshaft 36; an intake-side rocker arm 89 swung following the intake-side cam 87; and an exhaust-side rocker arm (not shown) swung following the exhaust-side cam 88. Each of the intake-side and exhaust-side rocker arms 89 and 80 is swingably supported at one end on the cylinder head 74 through a common swinging support shaft 91 having an axis parallel to the crankshaft 27. A tappet screw 92 is threadedly engaged with the other end of the intake-side rocker arm 89 and 40 to abut against an upper end of the intake valve 83, so that it is advanced and retracted positions can be regulated. A tappet screw (not shown) is threadedly engaged with the other end of the exhaust-side rocker arm to abut against an upper end of the exhaust valve 84, so that its advanced and retracted positions can be regulated.

The camshaft 86 is rotatably supported between the cylinder head 74 and the head cover 75, and has an axis parallel to the crankshaft 77. A timing transmitting means 95 is mounted between the camshaft 86 and the crankshaft 77, and disposed between one 77*a* of the pair of balance weights 77*a* and 77*b* of the crankshaft 77 and crankcase 72. The timing transmitting means 95 comprises a driving sprocket 96 fixed to the rotary shaft 77, a driven sprocket 97 mounted on the camshaft 86, and a timing belt 98 wound around the driving sprocket 96 and the driven sprocket 97. A belt chamber 99, in which the timing belt 53 is allowed to travel, is formed in the cylinder block 73 and the cylinder head 74.

A pivot shaft 100 having an axis eccentric from the rotational axis of the camshaft 86 is integrally provided on the camshaft 86 between the intake-side cam 87 and the exhaust-side cam 88. The pivot shaft 100, the piston 78 and the crankshaft 77 are connected to one another through a link mechanism 101.

The link mechanism 101 comprises: a main connecting rod 102 connected at one end to the piston 78 through a piston pin 105; a subsidiary connecting rod 103 connected to the crankpin 77*c* of the crankshaft 77 and connected to the other end of the main connecting rod 102; and a control rod 104 connected at one end to the subsidiary connecting rod 103 at a position offset from the connected position of the main connecting rod 102, and connected at other end to the pivot shaft 100.

The subsidiary connecting rod 103 is formed to come into sliding contact with one half of a peripheral surface of the crankpin 77*c*. A crank cap 106 mounted to come into sliding contact with the remaining half of the peripheral surface of the crankpin 77*c* is fastened to the subsidiary connecting rod 103.

The main connecting rod 102 is turnably connected at other end to one end of the subsidiary connecting rod 103 through a first pin 107. The control rod 104 is turnably connected at one end to the subsidiary connecting rod 103 through a second pin 108. A circular shaft bore 109 is provided in the other end of the control rod 104, so that the pivot shaft 100 is relatively slidably fitted in the circular shaft bore 109.

Moreover, centerlines of the main connecting rod 102 and the control rod 104 are disposed in the same plane perpendicular to the axis of the crankshaft 77. The control rod 104 extends vertically through an operating chamber 110 provided in the cylinder block 73 adjacent to the cylinder bore 79.

Thus, as the pivot shaft 100 is rotated at a reduction ratio of 1/2 in response to the rotation of the crankshaft 77, the link mechanism 101 is operated so that the stroke of the piston 78 at the expansion stroke is larger than that at the compression stroke, thereby performing a larger expansion task with the same amount of air-fuel mixture drawn. In this manner, a cycle heat efficiency can be enhanced.

The operation of the third embodiment will be described below. The timing transmitting means 95 for transmitting the rotational power of the crankshaft 77 at a reduction ratio of 1/2 is mounted between the camshaft 86 of the valve-operating mechanism 85 mounted at the upper portion of the engine body 21 and the crankshaft 77. The pivot shaft 100 having the axis eccentric from the rotational axis of the camshaft 86 is provided on the camshaft 86, and the control rod 104 constituting a portion of the link mechanism 101 is connected to the pivot shaft 100.

Namely, the valve-operating mechanism 85 is constructed to be an OHC-type, and hence it is possible to decrease the number of parts constituting the valve-operating mechanism 85 and to construct the valve-operating mechanism 85 at a relatively small weight, thereby easily increasing the rotational speed. Moreover, it is possible to reduce the mechanical noise by decreasing the number of contact portions between the parts constituting the valve-operating mechanism 85.

In addition, the rotational power reduced by the timing transmitting means 95 at a reduction ratio of 1/2 is transmitted from the crankshaft 77 to the camshaft 86 of the valve-operating mechanism 85. Because the pivot shaft 100 is provided on the camshaft 86, it is unnecessary to secure a space for disposition of the rotary shaft, as compared with a case where the rotary shaft having the pivot shaft is rotatably supported in the crankcase. In this manner, it is possible to compactly construct the crankcase 72 and to set the height of the engine to be lower. Moreover, it is unnecessary to provide a reducing drive mechanism for driving the rotary shaft between the rotary shaft and the crankshaft, and hence it is possible to reduce the length of the crankshaft 77 to compactly construct the entire engine. It is also possible to reduce the number of parts by eliminating the need of the rotary shaft.

Further, the control rod 104 is formed between the lower and upper portions of the engine body 71 to have a relatively large length, but it is possible to suppress the wearing by reducing deflection amount of the control rod 104 at a point of connection to the subsidiary connecting rod 103. Moreover, the control rod 104 having a weight increased due to the relatively large length performs a counter weight function, and thus it is possible to improve the dynamic balance of the crankshaft 77.

Additionally, because the centerlines of the main connecting rod 102 and the control rod 104 are disposed on the same plane, the main connecting rod 102, the subsidiary connecting rod 103 and the control rod 104 can be disposed compactly in a direction along the axis of the crankshaft 77, leading to a reduction in distance between the bearings at the opposite ends of the crankshaft 77. Further, a load on the main connecting rod 102 and the subsidiary connecting rod 103 due to the explosive force can be decreased by the displacement of the control rod 104 toward the crankshaft 77.

Although the embodiments of the present invention have been described in detail, the present invention is not limited to the above-described embodiments, and various modifications in design may be made without departing from the scope of the invention defined in claims.

What is claimed is:

1. A stroke-variable engine comprising:

a main connecting rod connected at one end to a piston through a piston pin;

a subsidiary connecting rod which is connected to a crankpin of a crankshaft rotatably supported in a crankcase of an engine body and which is connected to the other end of the main connecting rod;

a control rod connected at one end to the subsidiary connecting rod at a position offset from a connected position of the main connecting rod; and a pivot shaft which is rotatably supported in the crankcase so as to be rotatable about an eccentric axis parallel to the crankshaft and which is connected to the other end of the control rod so that a rotational power reduced at a reduction ratio of 1/2 is transmitted from the crankshaft to the pivot shaft, wherein a camshaft of a valve-operating mechanism mounted at an upper portion of the engine body and the pivot shaft are operatively connected to each other.

2. A stroke-variable engine according to claim 1, wherein the pivot shaft is provided at an eccentric position on a rotary shaft which is rotatably supported in the crankcase so as to be rotatable about the eccentric axis as a rotational axis and to which the rotational power reduced at a reduction ratio of 1/2 is transmitted from the crankshaft; and a timing transmitting means is mounted between the camshaft and the rotary shaft, and comprises a driven wheel mounted on the camshaft, a drive wheel mounted on the rotary shaft, and an endless power transmitting belt wound around the drive wheel and the driven wheel.

3. A stroke-variable engine according to claim 2, wherein a rotary shaft drive means for transmitting the rotational power from the crankshaft to the rotary shaft at a reduction ratio of 1/2 and the timing transmitting means are separately disposed on axially opposite sides of the crankpin.

4. A stroke-variable engine according to claim 2, wherein the crankcase comprises a case body with its one side opened, and a side cover coupled to an end of the opened side of the case body; and a rotary shaft drive means for transmitting the rotational power from the crankshaft to the rotary shaft at a reduction ratio of 1/2 and the timing transmitting means are disposed between the crankpin and the side cover, the timing transmitting means being disposed on the side of the side cover.

5. A stroke-variable engine according to any of claims 2 to 4, wherein the crankshaft includes a pair of balance weights which sandwich the subsidiary connecting rod from opposite sides.

6. A stroke-variable engine according to claim 1, wherein a timing transmitting means for transmitting the rotational power of the crankshaft at a reduction ratio of 1/2 is mounted between the camshaft of the valve-operating mechanism mounted at an upper portion of the engine body and the crankshaft; and the pivot shaft having an axis eccentric from the rotational axis of the camshaft is provided on the camshaft.

7. A stroke-variable engine according to claim 6, wherein centerlines of the main connecting rod and the control rod are disposed on the same plane.

* * * * *